US011488541B2

(12) United States Patent
Talebzadeh et al.

(10) Patent No.: US 11,488,541 B2
(45) Date of Patent: Nov. 1, 2022

(54) PIXEL MEASUREMENT THROUGH DATA LINE

(71) Applicant: Ignis Innovation Inc., Waterloo (CA)

(72) Inventors: Jafar Talebzadeh, Waterloo (CA); Ray Leerentveld, Palgrave (CA)

(73) Assignee: IGNIS INNOVATION INC., Waterloo (CA)

( * ) Notice: Subject to any disclaimer, the term of this patent is extended or adjusted under 35 U.S.C. 154(b) by 0 days.

(21) Appl. No.: 17/205,639

(22) Filed: Mar. 18, 2021

(65) Prior Publication Data

US 2021/0210024 A1 Jul. 8, 2021

Related U.S. Application Data

(63) Continuation of application No. 16/028,073, filed on Jul. 5, 2018, now Pat. No. 10,971,078, which is a continuation-in-part of application No. 15/968,134, filed on May 1, 2018, now abandoned.

(60) Provisional application No. 62/629,450, filed on Feb. 12, 2018.

(51) Int. Cl.

| | |
|---|---|
| ***G09G 3/3283*** | (2016.01) |
| ***G09G 3/325*** | (2016.01) |
| ***G09G 3/00*** | (2006.01) |
| ***H05B 45/60*** | (2022.01) |

(52) U.S. Cl.

CPC ..... *G09G 3/3283* (2013.01); *G09G 3/006* (2013.01); *G09G 3/325* (2013.01); *H05B 45/60* (2020.01)

(58) Field of Classification Search

None

See application file for complete search history.

(56) References Cited

U.S. PATENT DOCUMENTS

| | | | | |
|---|---|---|---|---|
| 2008/0111812 | A1* | 5/2008 | Shirasaki | G09G 3/3291 345/212 |
| 2013/0099692 | A1* | 4/2013 | Chaji | G09G 3/3291 315/224 |
| 2018/0144674 | A1* | 5/2018 | Gupta | G09G 3/3266 |

FOREIGN PATENT DOCUMENTS

| | | | |
|---|---|---|---|
| CN | 102246220 | A | 11/2011 |
| CN | 105830144 | A | 8/2016 |

* cited by examiner

*Primary Examiner* — Chad M Dicke

(74) *Attorney, Agent, or Firm* — Stratford Group Ltd.

(57) ABSTRACT

A system and method for determining the current of a pixel circuit and an organic light emitting diode (OLED). The pixel circuit is connected to a source driver by a data line. The voltage (or current) supplied to the pixel circuit by the source driver. The current of the pixel and the OLED can be measured by a readout circuit. A value of a voltage from the measured current can be extracted and provided to a processor for further processing.

20 Claims, 13 Drawing Sheets

PIXEL MEASUREMENT THROUGH DATA LINE

CROSS REFERENCE TO RELATED APPLICATIONS

This application is a continuation of U.S. patent application Ser. No. 16/028,073, filed Jul. 5, 2018, now allowed, which is a continuation-in-part of U.S. patent application Ser. No. 15/968,134, filed May 1, 2018, which claims the benefit of U.S. Provisional Application No. 62/629,450, each of which is hereby incorporated by reference herein in their entireties.

BACKGROUND

Organic light emitting diode (OLED) displays have gained significant interest recently in display applications in view of their faster response times, larger viewing angles, higher contrast, lighter weight, lower power, amenability to flexible substrates, as compared to liquid crystal displays (LCDs).

OLED displays can be created from an array of light emitting devices each controlled by individual circuits (i.e., pixel circuits) having transistors for selectively controlling the circuits to be programmed with display information and to emit light according to the display information. Thin film transistors ("TFTs") fabricated on a substrate can be incorporated into such displays. TFTs tend to demonstrate non-uniform behavior across display panels and over time as the displays age. Compensation techniques can be applied to such displays to achieve image uniformity across the displays and to account for degradation in the displays as the displays age. Some schemes for providing compensation to displays to account for variations across the display panel and over time utilize monitoring systems to measure time dependent parameters associated with the aging (i.e., degradation) of the pixel circuits. The measured information can then be used to inform subsequent programming of the pixel circuits so as to ensure that any measured degradation is accounted for by adjustments made to the programming. The prior art monitored pixel circuits, however, require the use of additional feedback lines and transistors to selectively couple the pixel circuits to the monitoring systems and provide for reading out information. The incorporation of additional feedback lines and transistors may undesirably add significantly to the cost yield and reduces the allowable pixel density on the panel.

SUMMARY OF THE INVENTION

Aspects of the present disclosure include a method of determining the current of a pixel circuit connected to a source driver by a data line. The method includes supplying voltage (or current) to the pixel circuit from the source via the data line, measuring the current and extracting the value of the voltage from the current measurement. The pixel circuit may include a light-emitting device, such as an organic light emitting diode (OLED), and may also include a thin field transistor (TFT).

In this aspect of the present disclosure further includes the source driver having a readout circuit that is utilized for measuring the current provided by the source driver to the pixel circuit. The current is converted into a digital code, i.e. a 10 to 16 bit digital code. The digital code is provided to a digital processor for further processing.

The foregoing and additional aspects and embodiments of the present invention will be apparent to those of ordinary skill in the art in view of the detailed description of various embodiments and/or aspects, which is made with reference to the drawings, a brief description of which is provided next.

DETAILED DESCRIPTION

Figure 1:
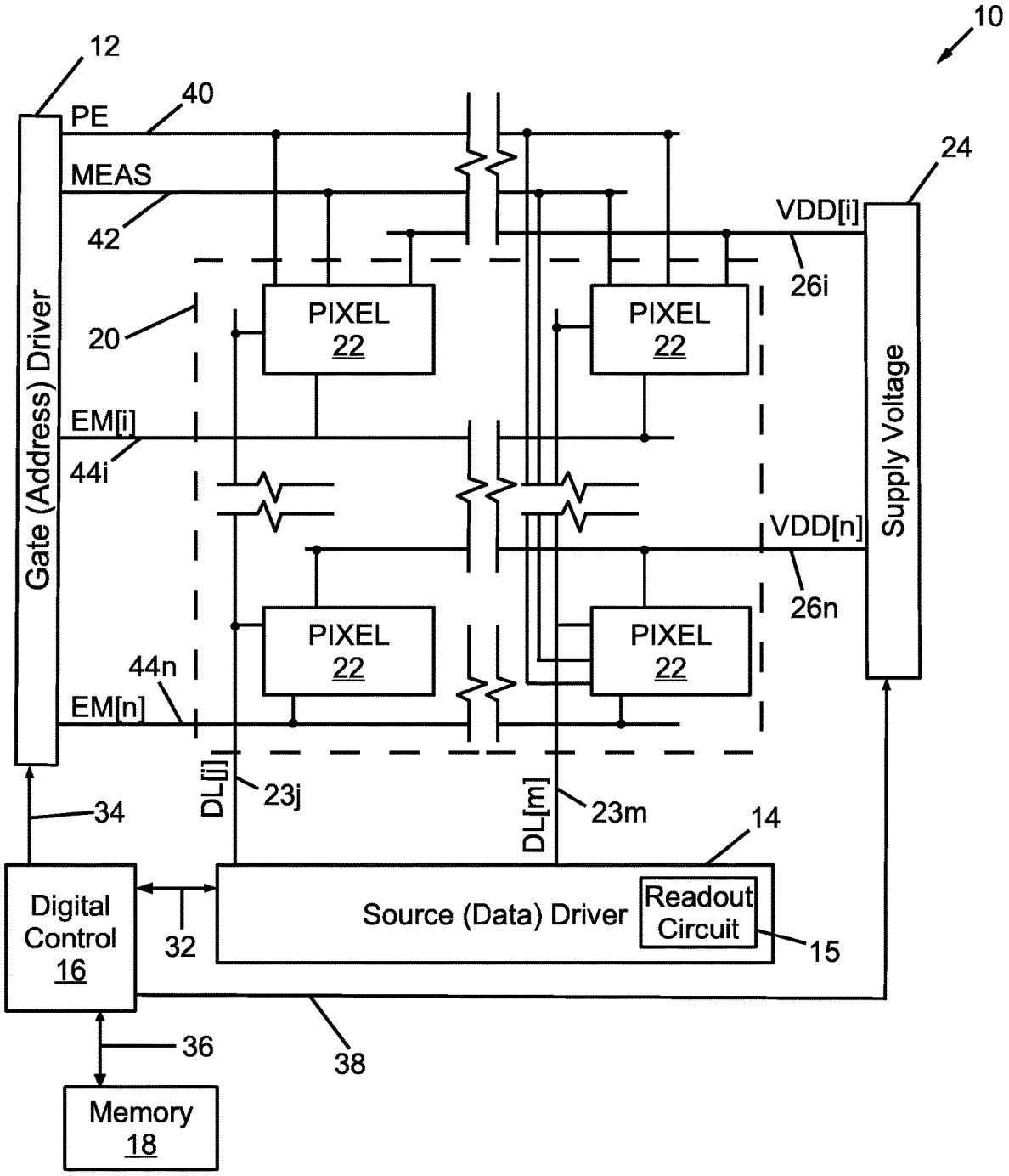
FIG. 1 is a block diagram of an OLED display in accordance with embodiments of the present invention.

FIG. 1 is a diagram of an exemplary display system 10. The display system 10 includes a gate driver 12, a source driver 14, a digital controller 16, a memory storage 18, and display panel 20. The display panel 20 includes an array of pixels 22 arranged in rows and columns. Each of the pixels 22 is individually programmable to emit light with individually programmable luminance values. The controller 16 receives digital data indicative of information to be displayed on the display panel 20. The controller 16 sends signals 32 to the source driver 14 and scheduling signals 34 to the gate driver 12 to drive the pixels 22 in the display panel 20 to display the information indicated. The plurality of pixels 22 associated with the display panel 20 thus comprise a display array ("display screen") adapted to dynamically display information according to the input digital data received by the controller 16. The display screen can display, for example, video information from a stream of video data received by the controller 16. The supply voltage 24 can provide a constant power voltage or can be an adjustable voltage supply that is controlled by signals from the controller 116. The display system 10 can also incorporate features from a current source or sink (not shown) to provide biasing currents to the pixels 22 in the display panel 20 to thereby decrease programming time for the pixels 22.

For illustrative purposes, the display system 10 in FIG. 1 is illustrated with only four pixels 22 in the display panel 20. It is understood that the display system 10 can be implemented with a display screen that includes an array of similar pixels, such as the pixels 22, and that the display screen is not limited to a particular number of rows and columns of pixels. For example, the display system 10 can be implemented with a display screen with a number of rows and columns of pixels commonly available in displays for mobile devices, monitor-based devices, and/or projection-devices.

The pixel 22 is operated by a driving circuit ("pixel circuit") that generally includes a driving transistor and a light emitting device. Hereinafter the pixel 22 may refer to the pixel circuit. The light emitting device can optionally be an organic light emitting diode, but implementations of the present disclosure apply to pixel circuits having other electroluminescence devices, including current-driven light emitting devices. The driving transistor in the pixel 22 can optionally be an n-type or p-type amorphous silicon thin-film transistor, but implementations of the present disclosure are not limited to pixel circuits having a particular polarity of transistor or only to pixel circuits having thin-film transistors. The pixel circuit 22 can also include a storage capacitor for storing programming information and allowing the pixel circuit 22 to drive the light emitting device after being addressed. Thus, the display panel 20 can be an active matrix display array.

As illustrated in FIG. 1, the pixel 22 illustrated as the top-left pixel in the display panel 20 is coupled to a power enable (PE) signal line 40, measurement (MEAS) signal line 42, a supply line 26*i*, a data line 23*j*, and an enable measurement (EM) signal line 44*i*. The supply line 26*i* may be charged with VDD.

The top-left pixel 22 in the display panel 20 can correspond a pixel in the display panel in a "ith" row and "jth" column of the display panel 20. Similarly, the top-right pixel 22 in the display panel 20 represents a "jth" row and "mth" column; the bottom-left pixel 22 represents an "nth" row and "jth" column; and the bottom-right pixel 22 represents an "nth" row and "mth" column. Each of the pixels 22 is coupled to the PE signal line 40, MEAS signal line 42; along with the appropriate supply lines (e.g., the supply lines 26*i* and 26*n*), data lines (e.g., the data lines 23*j* and 23*m*), and EM signal lines (e.g., the EM signal lines 44*i* and 44*n*). It is noted that aspects of the present disclosure apply to pixels having additional connections, such as connections to a select line.

With reference to the top-left pixel 22 shown in the display panel 20, PE signal line 40 and MEAS signal line 42 are provided by the gate driver 12, and can be utilized to enable, for example, a programming operation of the pixel 22 by activating a switch or transistor to allow the data line 23*j* to program the pixel 22. The data line 23*j* conveys programming information from the source driver 14 to the pixel 22. For example, the data line 23*j* can be utilized to apply a programming voltage or a programming current to the pixel 22 in order to program the pixel 22 to emit a desired amount of luminance. The programming voltage (or programming current) supplied by the source driver 14 via the data line 23*j* is a voltage (or current) appropriate to cause the pixel 22 to emit light with a desired amount of luminance according to the digital data received by the controller 16. The programming voltage (or programming current) can be applied to the pixel 22 during a programming operation of the pixel 22 so as to charge a storage device within the pixel 22, such as a storage capacitor, thereby enabling the pixel 22 to emit light with the desired amount of luminance during an emission operation following the programming operation. For example, the storage device in the pixel 22 can be charged during a programming operation to apply a voltage to one or more of a gate or a source terminal of the driving transistor during the emission operation, thereby causing the driving transistor to convey the driving current through the light emitting device according to the voltage stored on the storage device.

Generally, in the pixel 22, the driving current that is conveyed through the light emitting device by the driving transistor during the emission operation of the pixel 22 is a current that is supplied by the supply line 26*i*. The supply line 26*i* can provide a positive supply voltage (e.g., the voltage commonly referred to in circuit design as "VDD").

The display system 10 also includes a readout circuit 15 which is integrated with the source driver 14. With reference again to the top left pixel 22 in the display panel 20, the data line 23*j* connects the pixel 22 to the readout circuit 15. The data line 23*j* allows the readout circuit 15 to measure a current associated with the pixel 22 and hereby extract information indicative of a degradation of the pixel 22. Readout circuit 15 converts the associated current to a corresponding voltage. This voltage is converted into a 10 to 16 bit digital code and is sent to the digital control 16 for further processing or compensation.

Figure 2:
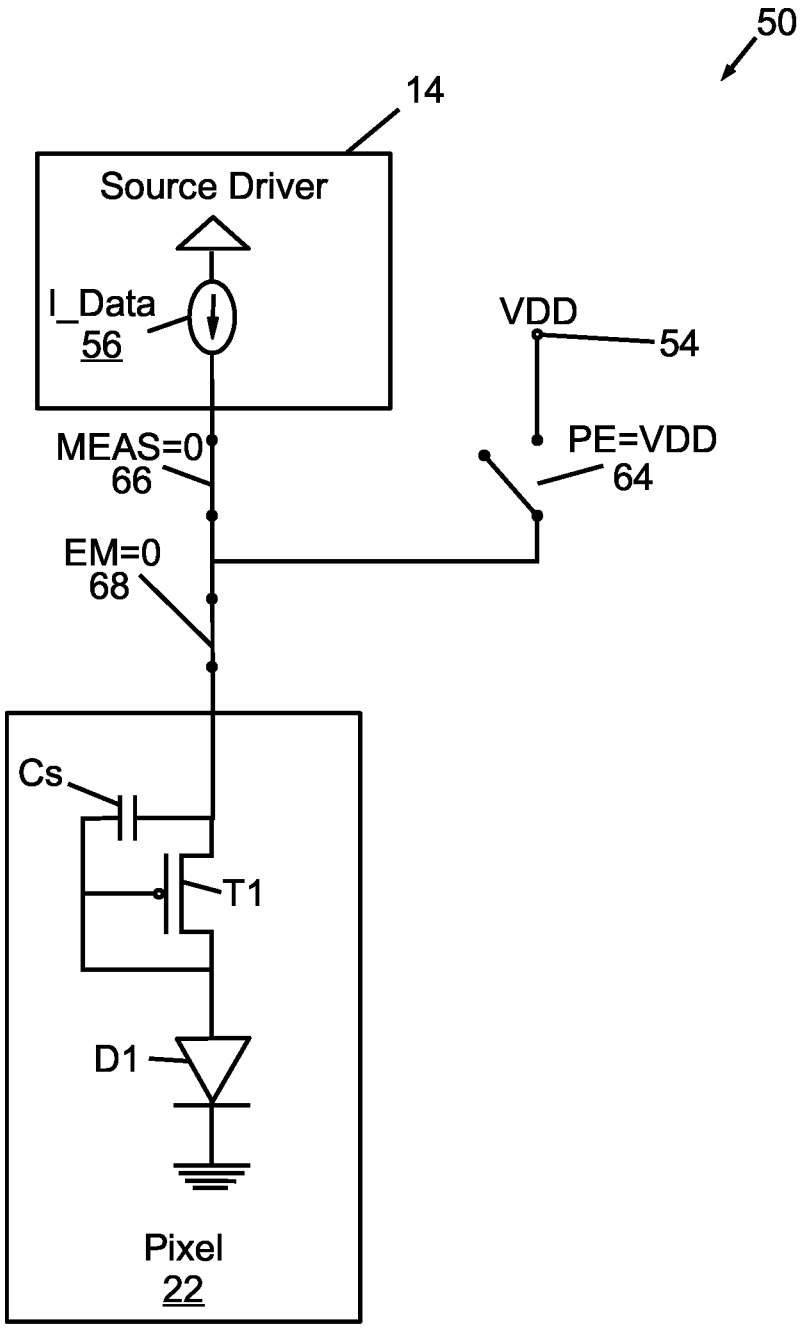
FIG. 2 is a block diagram of an embodiment of a pixel driver circuit in programming mode for the OLED display in FIG. 1.

FIG. 2 is a circuit diagram of a simple individual driver circuit 50 which contains a pixel 22, a source driver 14 and three switches controlling by MEAS 66, EM 68 and PE 64 signal. The pixel 22 in FIG. 2 include a drive transistor T1 coupled to an organic light emitting device D1 and a storage capacitor $C_S$ for storing programming information and allowing the pixel circuit 22 to drive the light emitting device after being addressed. In FIG. 2, circuit 50 is in programming mode.

As explained above, each pixel 22 in the display panel 20 in FIG. 1 is driven by the method shown in the driver circuit 50 in FIG. 2.The driver circuit 50 includes a drive transistor T1 coupled to an organic light emitting device D1, a storage capacitor $C_S$ for storing programming information and a source driver 14 and three switches controlling by MEAS 66, EM 68 and PE 64 signal. In this example, the organic light emitting device D1 is a luminous organic material which is activated by current flow and whose brightness is a function of the magnitude of the current. A supply voltage input 54 is coupled to the drain of the drive transistor T1. The supply voltage input 54 in conjunction with the drive transistor T1 supplies current to the light emitting device D1. The current level may be controlled via the source driver 14 in FIG. 1. In one example, the drive transistor T1 is a thin film transistor fabricated from hydrogenated amorphous silicon. In another example, low-temperature polycrystalline-silicon thin-film transistor ("LTPS-TFT") technology can also be used. Other circuit components such as capacitors and transistors (not shown) may be added to the simple driver circuit 50 to allow the pixel to operate with various enable, select and control signals such as those input by the gate driver 12 in FIG. 1. Such components are used for faster programming of the pixels, holding the programming of the pixel during different frames and other functions.

When the pixel 22 is required to have a defined brightness in applications, the gate of the drive transistor T1 is charged to a voltage where the transistor T1 generates a corresponding current to flow through the organic light emitting device (OLED) D1, creating the required brightness. The voltage at the gate of the transistor T1 can be either created by direct charging of the node with a voltage or self-adjusted with an external current.

During the programming mode, rows of pixels 22 are selected on a row by row basis. For example, the "ith" row of pixels 22 are selected and enabled by the gate driver 12, in which the EM signal line 44*i* is set to zero, i.e. EM=0. All pixels 22 in the "ith" row are connected to the source driver 14, such that the MEAS signal line 42 is set to zero, i.e. MEAS=0, and the PE signal line 40 is set to equal VDD, i.e. PE=VDD, for the "ith" row. The data is converted to data current, referred to as I_DATA 56 and flows into pixel. This data current 56 generates a Vgs voltage in T1 transistor which is stored in $C_S$ capacitor. When the pixel is in operational mode and is connected VDD, the voltage stored in $C_S$ capacitor generated a current in T1 transistor which is equal to I_DATA 56.

Figure 3:
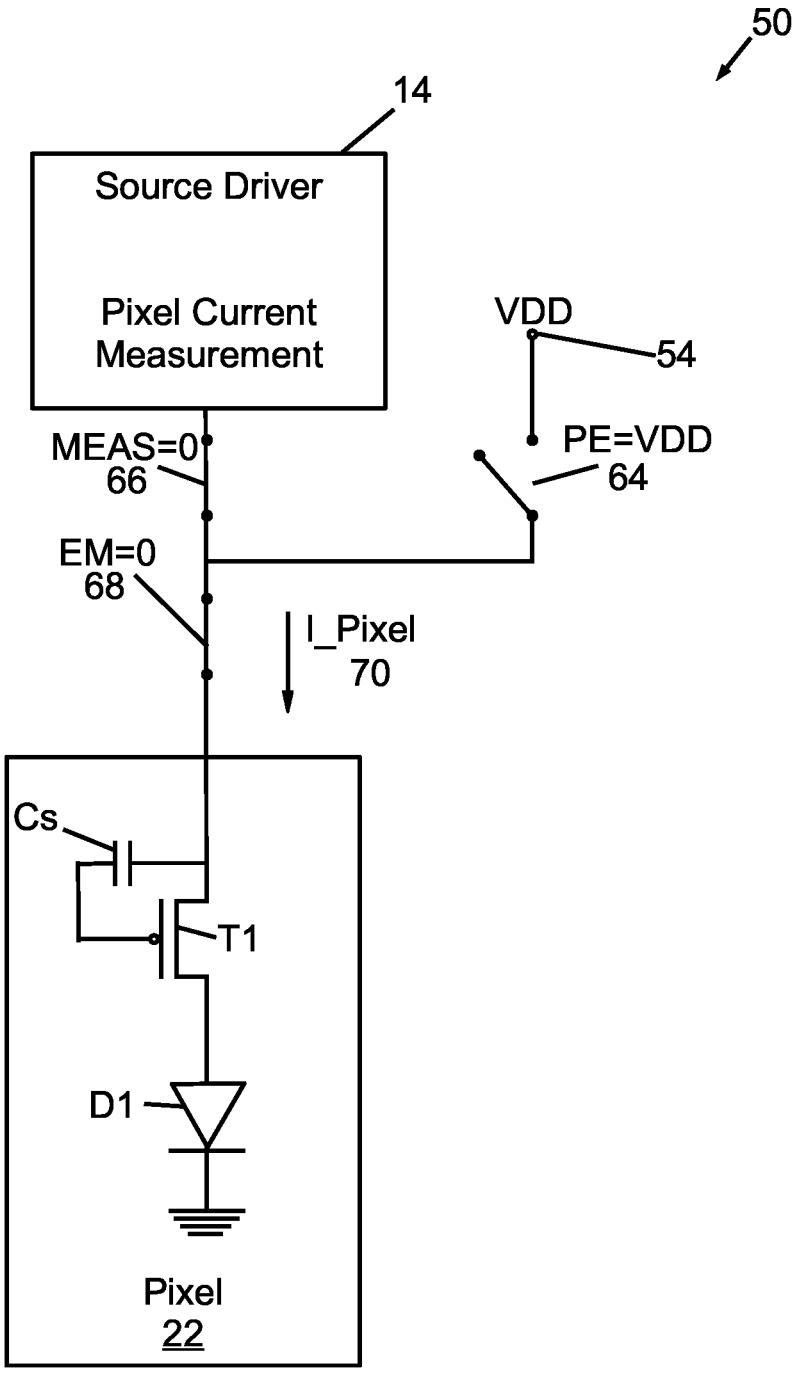
FIG. 3 is a block diagram of an embodiment of a pixel driver circuit in measurement mode for the OLED display in FIG. 1.

FIG. 3 is the circuit diagram of the simple individual driver circuit 50 as illustrated in FIG. 2 when in measurement mode. During the measurement mode, each row of pixels 22 are selected on a row by row basis, and enabled by the gate driver 11, i.e. EM=0, and all pixels 22 are connected to the source driver 14, i.e. MEAS=0 and PE=VDD, as described in FIG. 2. The pixel current, I_Pixel, 70 flows into source driver 14 and is measured by a Readout Circuit (ROC) 15. The ROC 15 measures the pixel current 70 and converts it to a correspondence voltage. This voltage is converted to 10 to 16 bit digital code and is sent to digital processor to be used for further processing or compensation.

Figure 4:
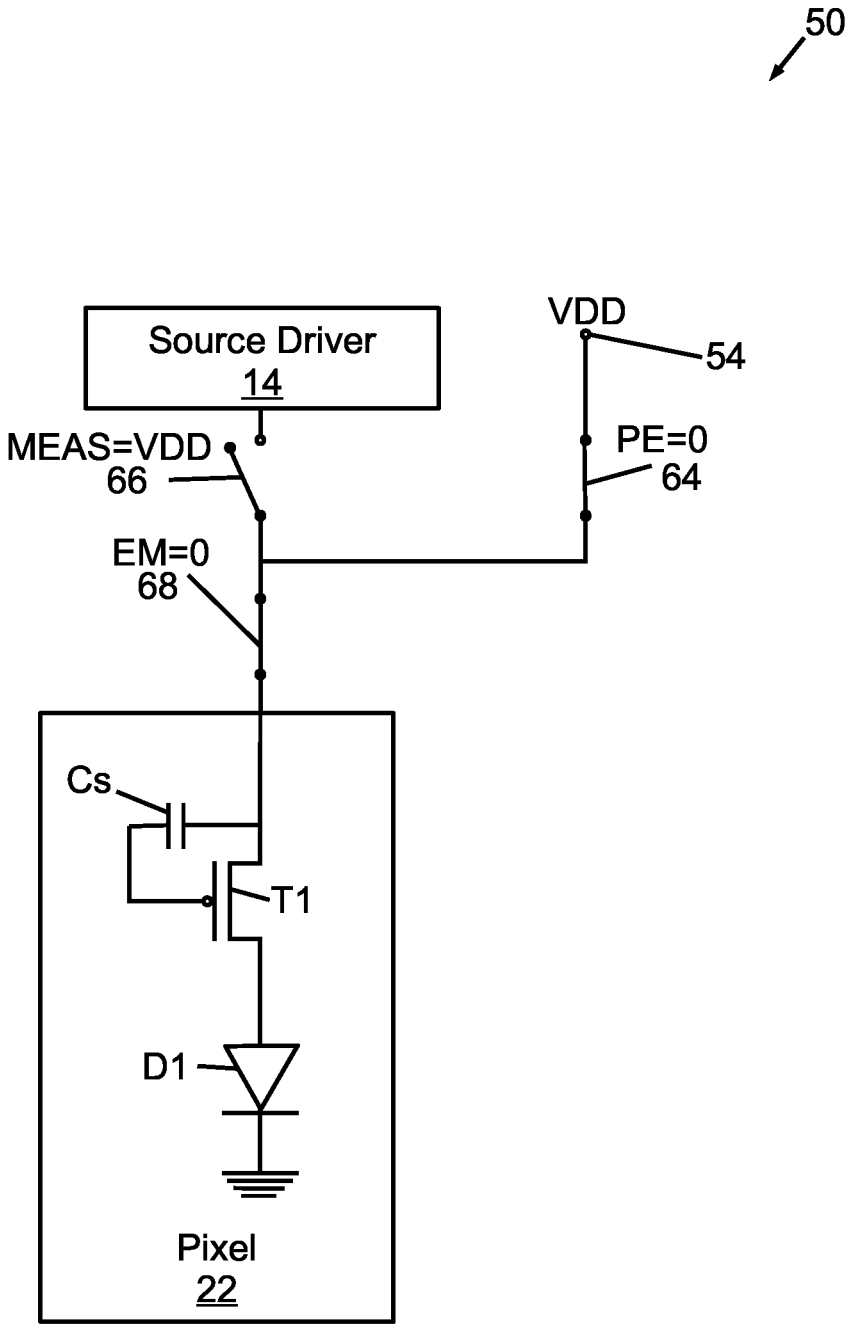
FIG. 4 is a block diagram of an embodiment of a pixel driver circuit in normal operation mode for the OLED display in FIG. 1.

FIG. 4 is the circuit diagram of the simple individual driver circuit 50 as illustrated in FIG. 2 when in normal operation mode. Normal operation mode may occur after the programming of all the rows. During normal operation mode, all pixels 22 are connected to their specific supply line, e.g. the "ith" row is connected to supply line 26*i*, while all pixels are disconnected from source driver 14, such that the MEAS signal line 42 is set to VDD, i.e. MEAS=VDD, and the PE signal line 40 is set to equal zero, i.e. PE=0, for the "ith" row. Pixel current, I_Pixel, 70 which is equal to the data current, I_Data, 56 flows into pixel 22 and OLED D1 has a luminance correspondence to the Pixel current 70.

Figure 5:
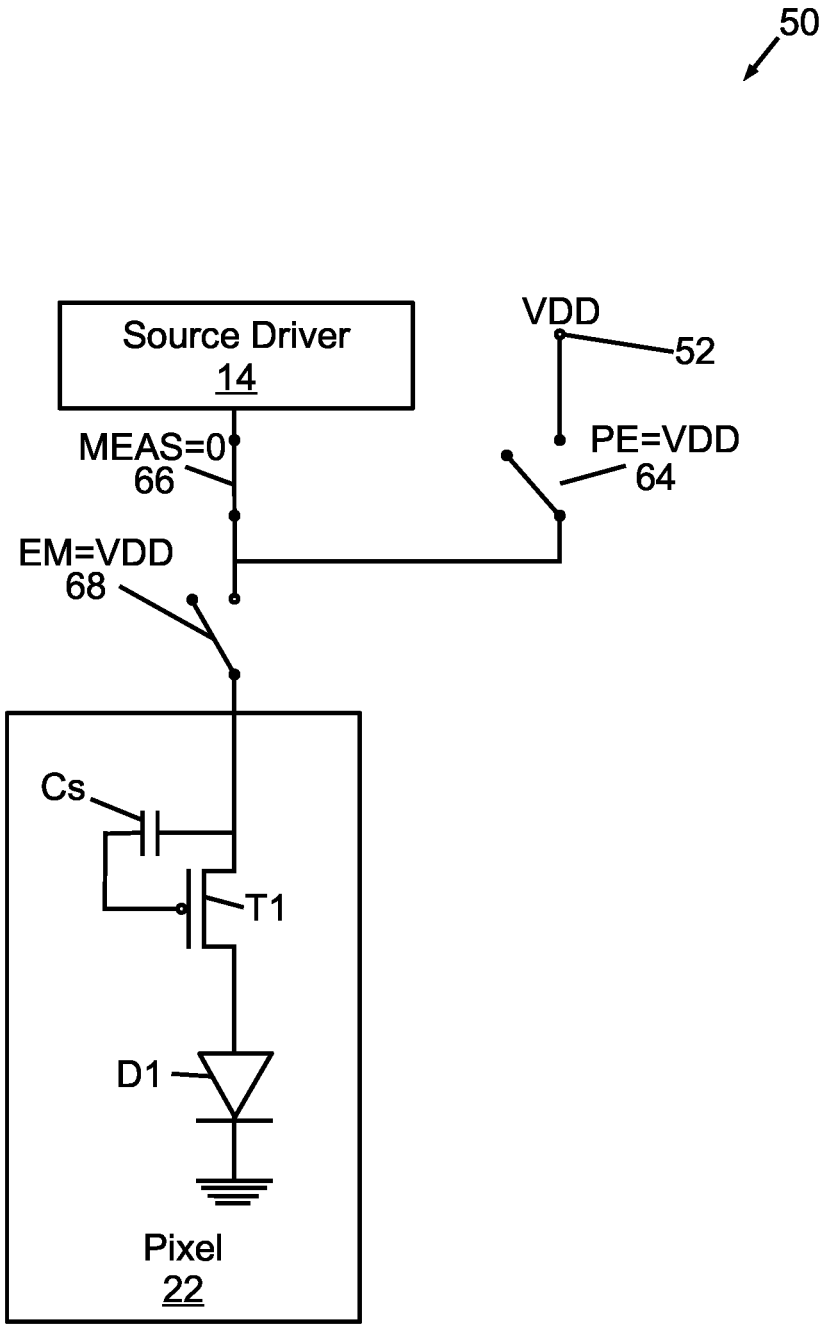
FIG. 5 is a block diagram of an embodiment of a pixel driver circuit in programming mode which is not selected by the Enable Management signal for the OLED display in FIG. 1.

FIG. 5 is the circuit diagram of the simple individual driver circuit 50 as illustrated in FIG. 2 when in programming mode but when the programming is directed toward another row. During the programming mode, the programming is performed on a row by row basis. The results in only one row of pixels 22, i.e. the "ith" row, being connected to source driver 14 while the remaining rows of pixels 22, i.e. the "jth" row, are off with no pixel current 70. During this time, the EM signal line 44*j* is set to VDD, i.e. EM=VDD, while the MEAS signal line 42 is set to zero, i.e. MEAS=0, and the PE signal line 40 is set to equal VDD, i.e. PE=VDD, for the "ith" row. During this time, there will be only a leakage current flowing into the OLED D1 and pixel 22 as shown in FIG. 5.

Figure 6:
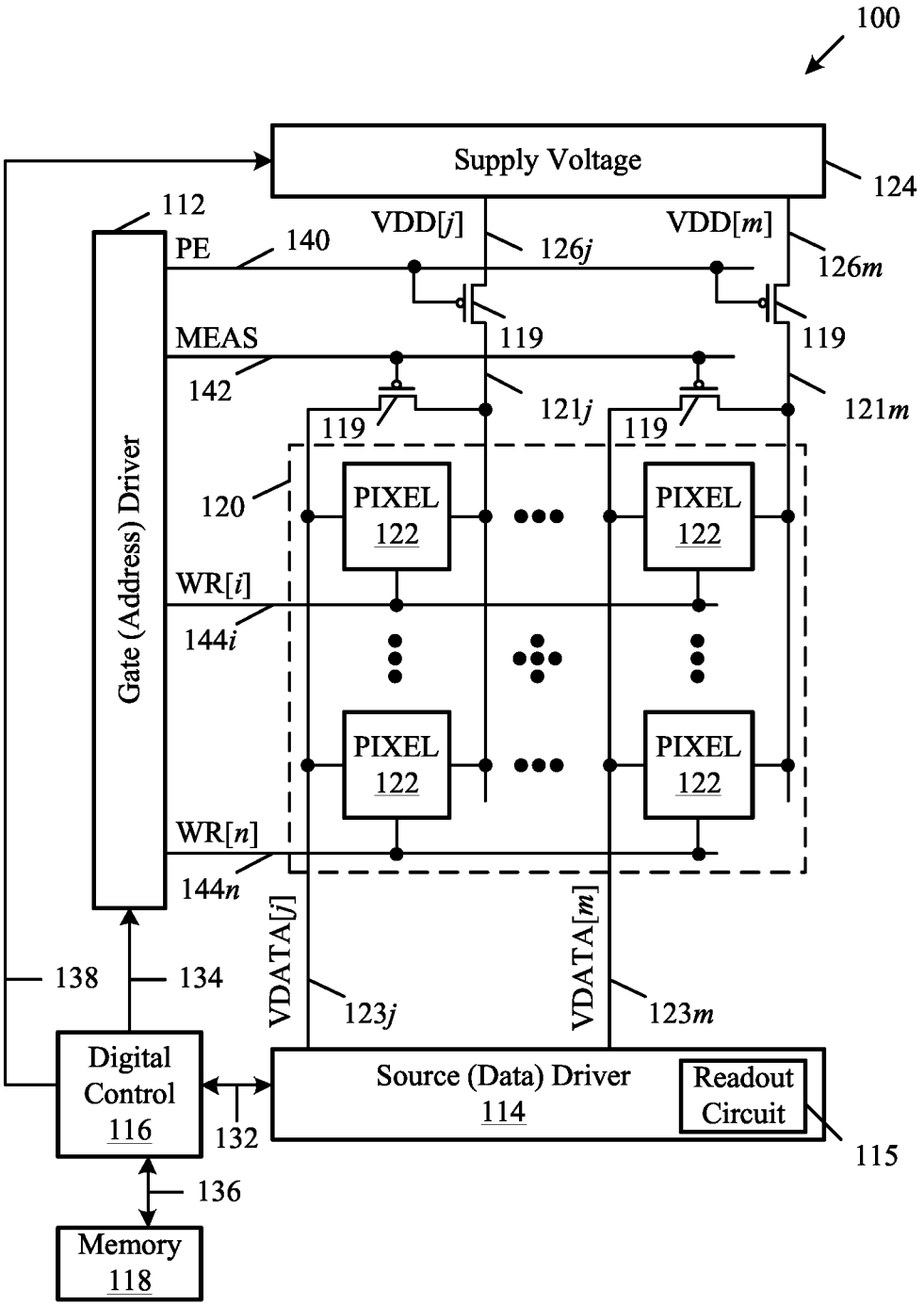
FIG. 6 is a block diagram of an OLED display in accordance with embodiments of the present invention.

FIG. 6 is a diagram of an exemplary display system 100. The display system 100 includes a gate driver 112, a source driver 114, a digital controller 116, a memory storage 118, and display panel 120 and two TFT transistors 119 working as switches for each column. The display panel 120 includes an array of pixels 122 arranged in rows and columns. Each of the pixels 122 is individually programmable to emit light with individually programmable luminance values. The controller 116 receives digital data indicative of information to be displayed on the display panel 120. The controller 116 sends signals 132 to the source driver 114 and scheduling signals 134 to the gate driver 112 to drive the pixels 122 in the display panel 120 to display the information indicated. The plurality of pixels 122 associated with the display panel 120 thus comprise a display array ("display screen") adapted to dynamically display information according to the input digital data received by the controller 116. The display screen can display, for example, video information from a stream of video data received by the controller 116. The supply voltage 124 can provide a constant power voltage or can be an adjustable voltage supply that is controlled by signals from the controller 116.

For illustrative purposes, the display system 100 in FIG. 6 is illustrated with only four pixels 122 in the display panel 120. It is understood that the display system 100 can be implemented with a display screen that includes an array of similar pixels, such as the pixels 122, and that the display screen is not limited to a particular number of rows and columns of pixels. For example, the display system 100 can be implemented with a display screen with a number of rows and columns of pixels commonly available in displays for mobile devices, monitor-based devices, and/or projection-devices.

The pixel 122 is operated by a driving circuit ("pixel circuit") that generally includes a driving transistor and a light emitting device. Hereinafter the pixel 122 may refer to the pixel circuit. The light emitting device can optionally be an organic light emitting diode (OLED), but implementations of the present disclosure apply to pixel circuits having other electroluminescence devices, including current-driven light emitting devices. The driving transistor in the pixel 122 can optionally be an n-type or p-type amorphous silicon thin-film transistor, but implementations of the present disclosure are not limited to pixel circuits having a particular polarity of transistor or only to pixel circuits having thin-film transistors. The pixel circuit 122 can also include a storage capacitor for storing programming information and allowing the pixel circuit 122 to drive the light emitting device after being addressed. Thus, the display panel 120 can be an active matrix display array.

As illustrated in FIG. 6, the pixel 122 illustrated as the top-left pixel in the display panel 120 is coupled to a power enable (PE) signal line 140, measurement (MEAS) signal line 142, a supply line 126*j*, a data line 123*j*, and a write (WR) signal line 144*i*. The supply line 126*j* may be charged with VDD.

The top-left pixel 122 in the display panel 120 can correspond a pixel in the display panel in an "ith" row and "jth" column of the display panel 120. Similarly, the top-right pixel 122 in the display panel 120 represents an "ith" row and "mth" column; the bottom-left pixel 122 represents an "nth" row and "jth" column; and the bottom-right pixel 122 represents an "nth" row and "mth" column. Each of the pixels columns is connected to two TFTs 119. One TFT 119 is coupled between the data line (123*j* and 123*m*) and pixel supply voltage line (121*j* and 121*m*) and is controlled by the PE signal line 140. The second TFT is coupled between pixel supply voltage line (121*j* and 121*m*) and supply voltage line (126*j* and 126*m*) and is controlled by the MEAS signal line 142; The display panel 120 is also coupled with the appropriate supply lines (e.g., the supply lines 126*j* and 126*m*), data lines (e.g., the data lines 123*j* and 123*m*), and write WR signal lines (e.g., the WR signal lines 144*i* and 144*n*). It is noted that aspects of the present disclosure apply to pixels having additional connections, such as connections to a select line or monitor line.

With reference to the top-left pixel 122 shown in the display panel 120, PE signal line 140, MEAS signal line 42 and W1R (144*i* and 144*n*) write signal are provided by the gate driver 112 land can be utilized to enable, for example, a programming operation of the pixel 122 by activating TFT transistors 119 and other switches or transistors in pixel 122 to allow the data line 123*j* to program the pixel 122. The data line 123*j* conveys programming information from the source driver 114 to the pixel 122. For example, the data line 123*j* can be utilized to apply a programming voltage or a programming current to the pixel 122 in order to program the pixel 122 to emit a desired amount of luminance. The programming voltage (or programming current) supplied by the source driver 114 via the data line 123*j* is a voltage (or current) appropriate to cause the pixel 122 to emit light with a desired amount of luminance according to the digital data received by the controller 116. The programming voltage (or programming current) can be applied to the pixel 122 during a programming operation of the pixel 122 so as to charge a storage device within the pixel 122, such as a storage capacitor, thereby enabling the pixel 122 to emit light with the desired amount of luminance during an emission operation following the programming operation. For example, the storage device in the pixel 122 can be charged during a programming operation to apply a voltage to one or more of a gate or a source terminal of the driving transistor during the emission operation, thereby causing the driving transistor to convey the driving current through the light emitting device according to the voltage stored on the storage device.

Generally, in the pixel 122, the driving current that is conveyed through the light emitting device by the driving transistor during the emission operation of the pixel 122 is a current that is supplied by the supply line 126*j*. The supply line 126*j* can provide a positive supply voltage (e.g., the voltage commonly referred to in circuit design as "VDD").

The display system 100 also includes a readout circuit 115 which is integrated with the source driver 114. With reference again to the top left pixel 122 in the display panel 120, the data line 123*j* connects the pixel 122 to the readout circuit 115. The data line 123*j* allows the readout circuit 115 to measure a current associated with the pixel 122 and hereby extract information indicative of a degradation of the pixel 122. Readout circuit 115 converts the associated current to a corresponding voltage. This voltage is converted into a 10 to 16 bit digital code and is sent to the digital control 116 for further processing or compensation.

Figure 7:
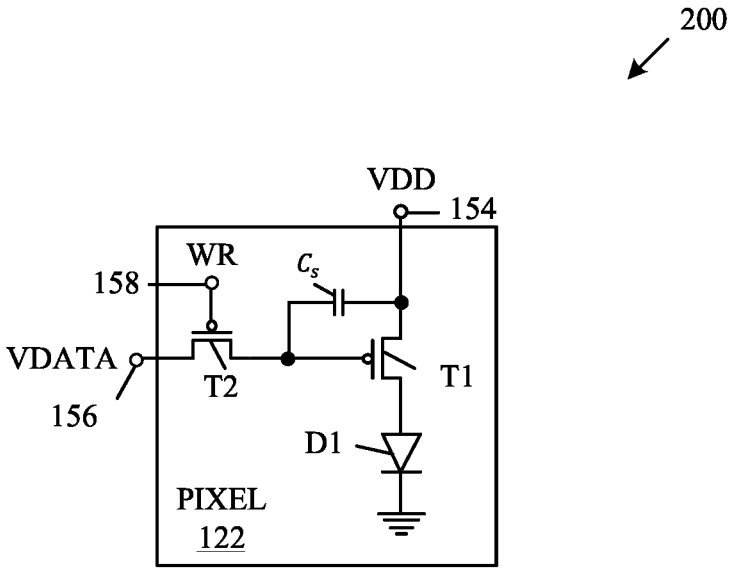
FIG. 7 is a block diagram of an embodiment of a pixel circuit which includes two TFTs, T1 and T2, an OLED and a capacitor.

FIG. 7 is a circuit diagram of a simple individual driver circuit 200 which contains a pixel 122 which is connected to supply voltage VDD 154, a data voltage VDATA 156 and is controlled by the write WR signal 158. The pixel 122 in FIG. 2 includes a switch transistor T2, a drive transistor T1 coupled to an organic light emitting device (OLED) D1, the switch transistor T2 and a storage capacitor $C_S$ for storing programming information and allowing the pixel circuit 122 to drive the light emitting device after being addressed. In FIG. 7, when the write WR signal 158 goes low, it enables the transistor T2 and the VDATA 156 is stored on the capacitor $C_S$. The Vgs (gate to source) voltage of the drive transistor T1 which is stored on the capacitor $C_S$ is equal to:

$$Vgs = VDATA - VDD$$

As explained above, each pixel 122 in the display panel 120 in FIG. 6 is driven by the method shown in the driver circuit 200 in FIG. 7. The driver circuit 200 includes a switch transistor T2, a drive transistor T1 coupled to an organic light emitting device (OLED) D1, a storage capacitor $C_S$ for storing programming information. VDATA 156 voltage comes from the source driver 114 and is stored on the capacitor $C_S$. The switch transistor T2 is controlled by WR 58 signal. In this example, the organic light emitting device (OLED) D1 is a luminous organic material which is activated by current flow and whose brightness is a function of the magnitude of the current. A supply voltage input 154 is coupled to the source (or drain) of the drive transistor T1. The supply voltage input 154 in conjunction with the drive transistor T1 supplies current to the light emitting device D1. The current level may be controlled via the source driver 114 in FIG. 6 and can be determined by the following formula:

$$I_{Pixel} = \tfrac{1}{2}k(VDATA - VDD - V_{th})^2$$

Where k depends on the size of the drive transistor T1 and $V_{th}$ is the threshold voltage of the drive transistor T1. In one example, the drive transistor T1 is a thin film transistor fabricated from hydrogenated amorphous silicon. In another example, low-temperature polycrystalline-silicon thin-film transistor ("LTPS-TFT") technology can also be used. Other circuit components such as capacitors and transistors (not shown) may be added to the simple driver circuit 200 to allow the pixel to operate with various enable, select and control signals such as those input by the gate driver 112 in FIG. 6. Such components are used for faster programming of the pixels, holding the programming of the pixel during different frames and other functions.

When the pixel 122 is required to have a defined brightness in applications, the gate of the drive transistor T1 is charged to a voltage where the transistor T1 generates a corresponding current to flow through the organic light emitting device (OLED) D1, creating the required brightness. The voltage at the gate of the transistor T1 can be either created by direct charging of the node with a voltage or self-adjusted with an external current.

During the programming mode, rows of pixels 122 are selected on a row by row basis. For example, the "ith" row of pixels 122 are selected and enabled by the gate driver 112, in which the WR signal line 144*i* is set to zero, i.e. WR=0. All pixels 122 in the "ith" row are connected to the source driver 114, such that the MEAS signal line 142 is set to VDD, i.e. MEAS=VDD, and the PE signal line 140 is set to equal 0, i.e. PE=0, for the "ith" row. The data VDATA (123*j* and 123*m*) as a voltage (or can be a current) is stored on the capacitors $C_S$ inside pixels 122. This data generates a Vgs voltage in T1 transistor which is stored in $C_S$ capacitor. When the pixel is in operational mode and is connected VDD, the voltage stored in $C_S$ capacitor generated a current in T1 transistor which is equal to:

$$I_{Pixel} = \tfrac{1}{2}k(VDATA - VDD - V_{th})^2$$

Pixel current, $I_{Pixel}$, flows into pixel 122 and OLED D1 has a luminance correspondence to the Pixel current.

Figure 8:
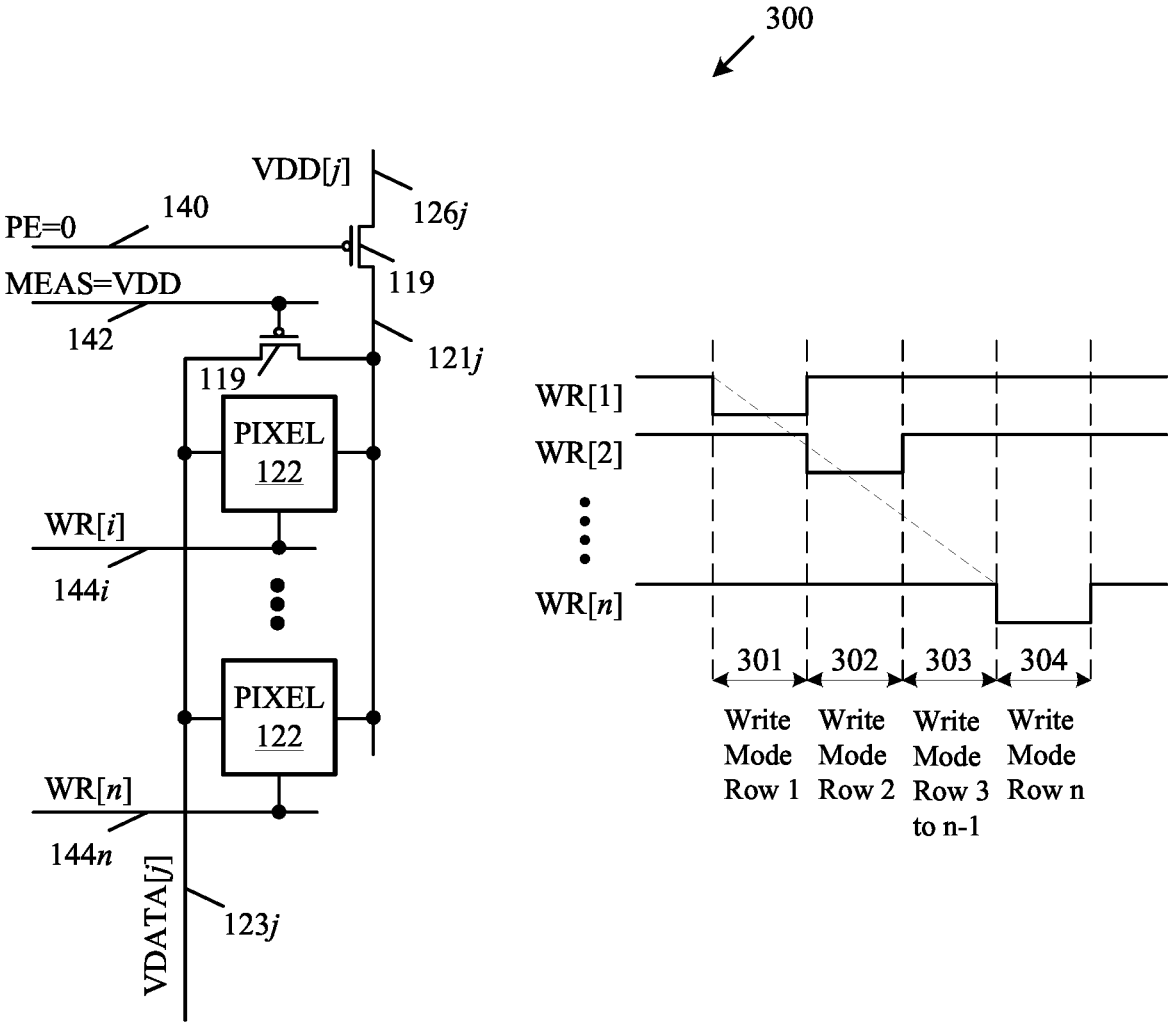
FIG. 8 is a block diagram of an embodiment of a column of pixel circuit ("jth" column) in programming mode.

FIG. 8 is a block diagram of an embodiment of a column of pixel circuit ("jth" column) 300 in programming modes. During the this mode, each row of the circuit 300 are selected on a row by row basis and enabled by the gate driver 112 in which the WR signal line 144*i* is set to zero, i.e. WR=0, and all pixels 122 are connected to the source driver 114 and the supply voltage VDD. The MEAS signal line 142 is set to VDD, i.e. MEAS=VDD, and the PE signal line 140 is set to equal 0, i.e. PE=0, as described in FIG. 8. In the first write mode 301, the write signal WR[1] is set to zero, i.e. WR[1]=0, and the row 1 is connected to the source driver 114 and the data VDATA[j] 123*j* is stored in capacitor $C_S$ in pixel in the row 1 and the "jth" column. In the second write mode 302, the write signal WR[2] is set to zero, i.e. WR[2]=0, and the row 2 is connected to the source driver 114 and the data VDATA[j] 123*j* is stored in capacitor $C_S$ in pixel in the row 2 and the "jth" column. In the third write mode 303, the write signal WR[i] (i=3 to n-1) is set to zero one by one, i.e. WR[i]=0 (i=3 to n-1), and the row i (i=3 to n-1) is connected to the source driver 114 one by one and the data VDATA[j] 123*j* is stored in capacitor $C_S$ in pixel in the "ith" row and the "jth" column. In the fourth write mode 304, the write signal WR[n] is set to zero, i.e. WR[n]=0, and the row n is connected to the source driver 114 and the data VDATA[j] 123*j* is stored in capacitor $C_S$ in pixel in the row n and the "jth" column.

In order to measure the pixel current, in the first step, all data line VDATA (123*j* and 123*m*) are set to have the same voltage as supply voltage (VDD) and all write signal WR (144*i* and 144*n*) are set to zero, i.e. WR[i]=0 (i=1 to n), then all capacitors' voltages inside pixel 122 will be zero and OLED devices D1 show black color. In the second step, the leakage current is measured. In the third step, the data is programmed on the row i. Finally, the row i is selected and the pixel current is measured.

Figure 9:
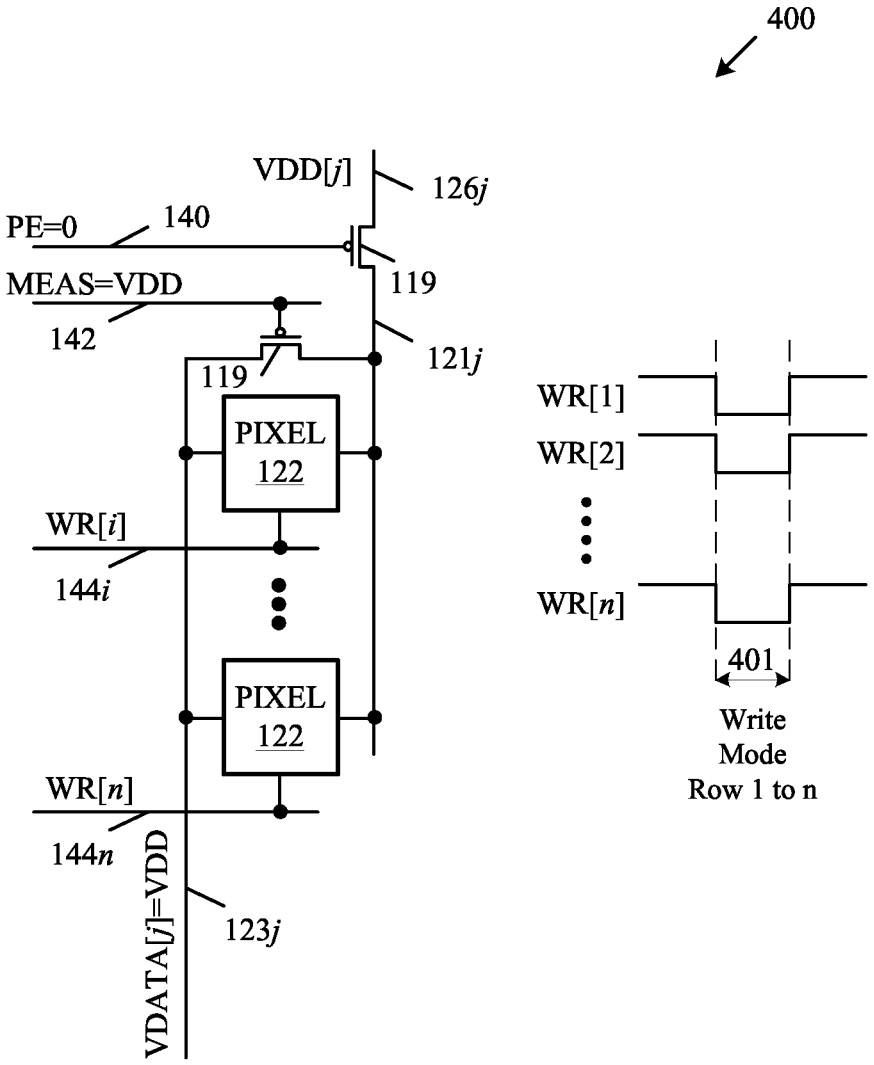
FIG. 9 is a block diagram of an embodiment of a column of pixel circuit ("jth" column). In this mode, data line has the same voltage as supply voltage (VDD) and all capacitors' voltages are set to be zero and OLED devices show black color.

FIG. 9 is a block diagram of an embodiment of a column of pixel circuit ("jth" column) 400 in programming mode. In first step, data line VDATA 123*j* has the same voltage as supply voltage VDD 126*j*. All write signals WR (144*i*, 144*n*) are set to zero, i.e. WR=0, and the MEAS signal line 142 is set to VDD, i.e. MEAS=VDD, and the PE signal line 140 is set to equal 0, i.e. PE=0, as described in FIG. 9. All pixels 122 in the circuit 400 are in write mode 401. All capacitors' voltages are set to zero and OLED devices D1 show black color. Alternatively all of the pixels can be driven to black one at a time sequentially similar to how the video is driven onto the panel.

Figure 10:
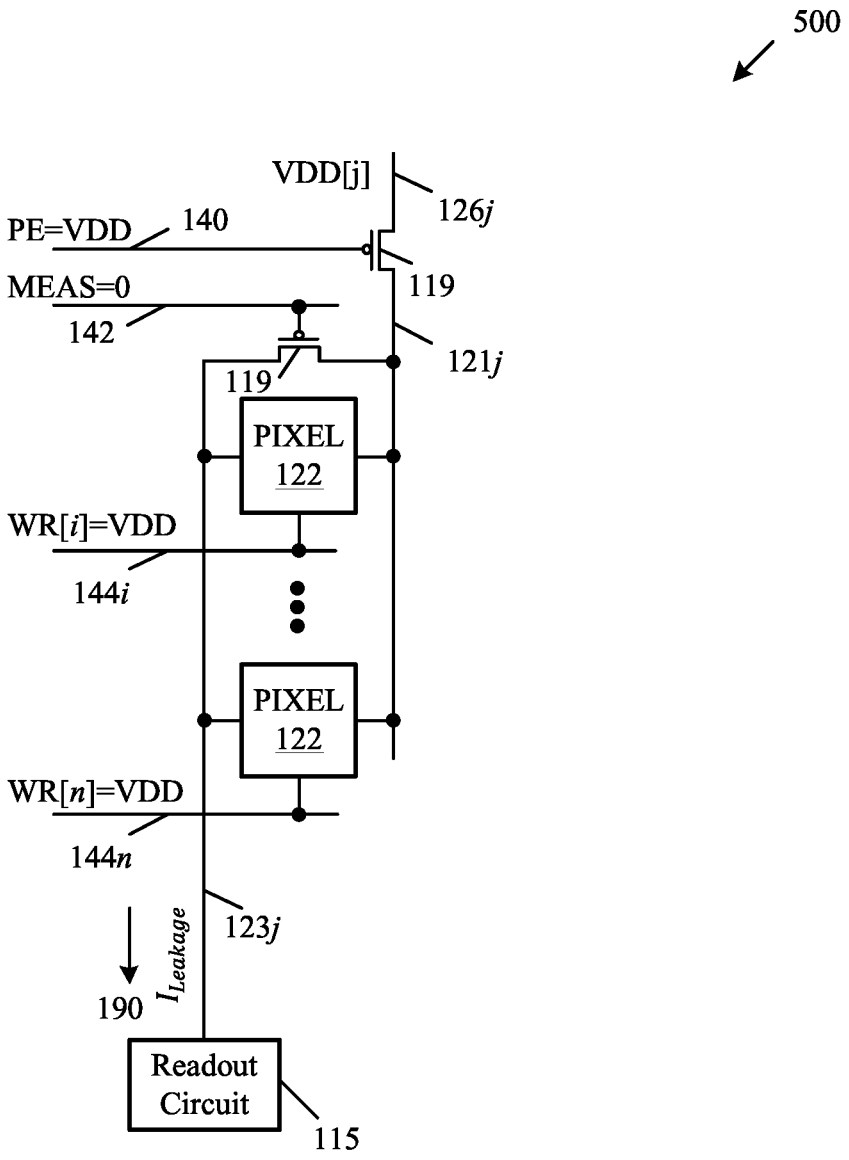
FIG. 10 is a block diagram of an embodiment of a column of pixel circuit ("jth" column) in measurement mode. The leakage current is measured in this mode.

FIG. 10 is a block diagram of an embodiment of a column of pixel circuit ("jth" column) 500 in measurement mode. In the second step, the leakage current is measured immediately after setting the capacitors' voltages of all pixels in the circuit 500 to zero. The WR signal line (144*i* and 144*n*) is set to VDD, i.e. WR=VDD, and the MEAS signal line 142 is set to 0, i.e. MEAS=0, and the PE signal line 140 is set to equal VDD, i.e. PE=VDD, as described in FIG. 10. The circuit 500 is disconnected from the supply voltage and connected to the data line, VDATA 123*j*. The leakage current of the pixels 122 in "jth" column (the circuit 500), $I_{Leakage}$ 190 flows into the source driver 114 and is measured by a Readout Circuit (ROC) 115. The ROC 115 measures the leakage current ($I_{Leakage}$) 190 and converts it to a correspondence voltage. This voltage is converted to 10 to 16 bit digital code and is sent to digital processor to be used for further processing or compensation.

Figure 11:
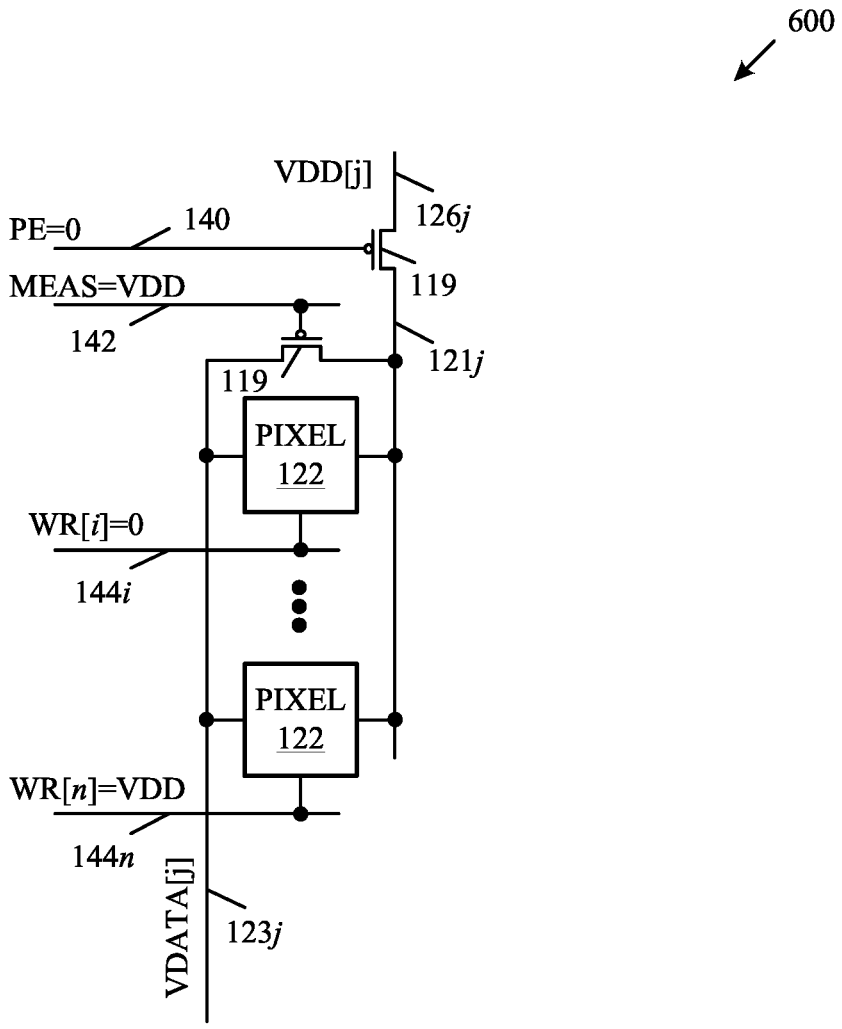
FIG. 11 is a block diagram of an embodiment of a column of pixel circuit ("jth" column) in programming mode. In this mode the "ith" row is programmed.

The third step is to write a data into the pixel which is of interested to measure its current. FIG. 11 is a block diagram of an embodiment of a column of pixel circuit ("jth" column) 600 in programming mode. In this mode the "ith" row is programmed. The WR signal line 144*i* is set to zero, i.e. WR[i]=0, and other WR signal lines 144*n* are set to equal VDD, i.e. WR[n]=VDD, and the MEAS signal line 142 is set to equal VDD, i.e. MEAS=VDD, and the PE signal line 140 is set to zero, i.e. PE=0, as described in FIG. 11. The pixel 122 in "ith" row is programmed to VDATA 123*j* and a current corresponded to it flows into the pixel. No current except for the leakage current flow into other pixel 122 in "jth" column.

Figure 12:
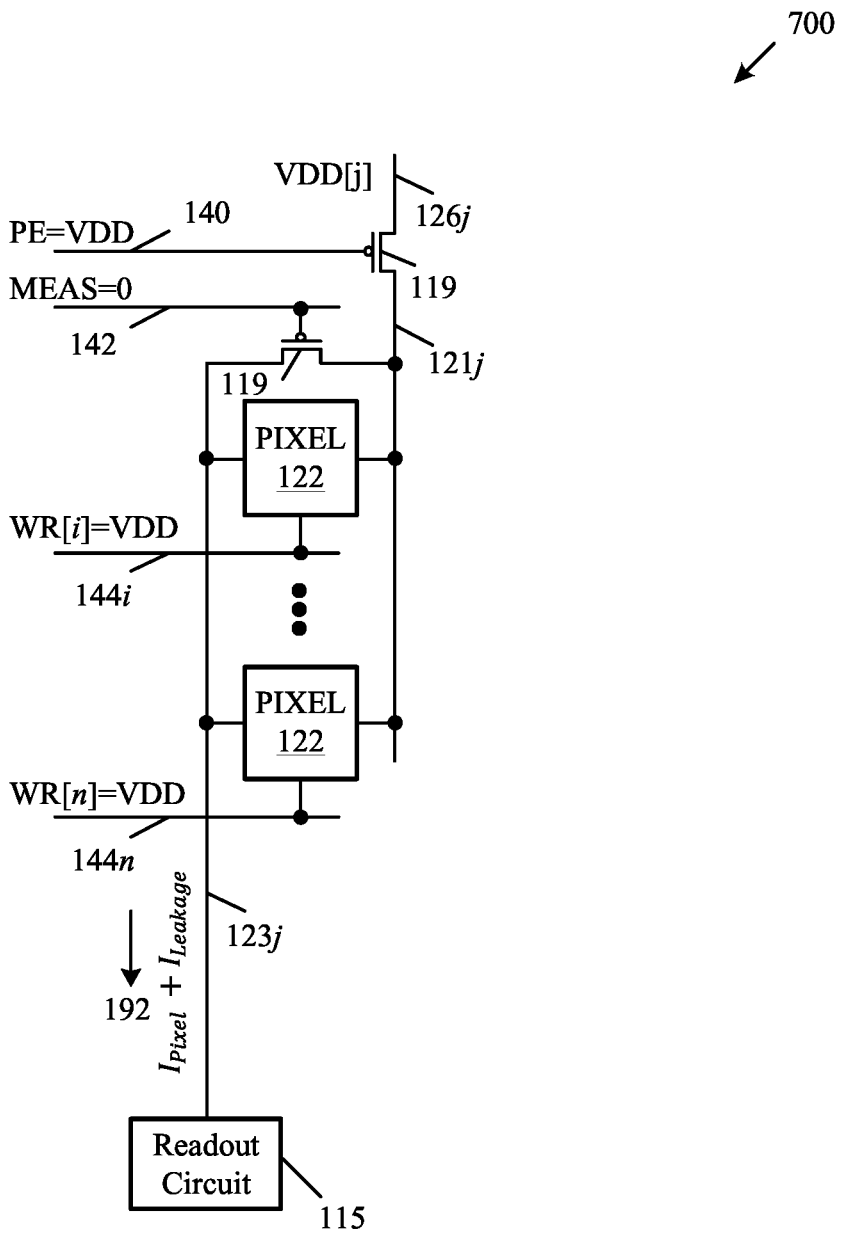
FIG. 12 is a block diagram of an embodiment of a column of pixel circuit ("jth" column) in measurement mode. The pixel current of the "ith" pixel plus the leakage currents of the other pixels are measured in this mode.

The last step is to measure the pixel current of the "ith" row. FIG. 12 is a block diagram of an embodiment of a column of pixel circuit ("jth" column) 700 in measurement mode. The pixel current of the "ith" row plus the leakage current of the other pixels are measured in this mode. The WR signal line (144*i* and 144*n*) is set to VDD, i.e. WR=VDD, and the MEAS signal line 142 is set to 0, i.e. MEAS=0, and the PE signal line 140 is set to equal VDD, i.e. PE=VDD, as described in FIG. 12. The circuit 700 is disconnected from the supply voltage and connected to the data line, VDATA 123*j*. The pixel current of the "ith" row plus the leakage current of other pixels in "jth" column (the circuit 700), $I_{Pixel}+I_{Leakage}$, 192 flows into the source driver 114 and is measured by a ROC 115. The ROC 115 measures the current 192 and converts it to a correspondence voltage. This voltage is converted to 10 to 16 bit digital code. The difference between the current measured in the last step and the leakage current in the step two, is the pixel current of the "ith" row pixel in "jth" column circuit 700 according to the following formula:

$$I_{Pixel}=(\text{current measured in step 4})-(\text{current measured in step 2})$$

$$I_{Pixel}=(I_{Pixel}+I_{Leakage})-(I_{Leakage})$$

In order to measure the OLED current, all four steps described to measure the pixel current are repeated here. In the step one as shown in FIG. 9, the data line is set to equal VDD and the capacitors' voltages inside pixels are set to zero. In the step two as shown in FIG. 10, the leakage current, $I_{Leakage}$, 190 of the pixels is measured. In the step three as shown in FIG. 11, the "ith" row is selected and the data line VDATA 123*j* is derived with lowest voltage. It causes the T1 transistor inside the "ith" pixel 122 is pushed to the triode region and behaves like a switch. In the step four as shown in FIG. 8, the OLED D1 of the "ith" pixel 122 is connected to virtual ground 806 of an integrator 810 through the T1 transistor inside the "ith" pixel 122 and the transistor 119 connected between the pixel supply voltage node 121*j* and the data line 123*j* and the switch 807 inside the ROC 115. By ignoring the voltage drop on the switches, the OLED D1 of the "ith" pixel 122 will have the same voltage as the bias voltage $V_B$ 805. The OLED current of the "ith" row pixel plus the leakage current of other pixels in "jth" column (the circuit 800), $I_{Oled}+I_{Leakage}$, 194 flows into the source driver 114 and is measured by a ROC 115. The ROC 115 measures the current 194 and converts it to a correspondence voltage. This voltage is converted to 10 to 16 bit digital code 802. The difference between the current measured in the step four and the leakage current in the step two, is the OLED current of the "ith" row pixel in "jth" column circuit 800 according to the following formula:

$$I_{Oled}=(\text{current measured in step 4})-(\text{current measured in step 2})$$

$$I_{Oled}=(I_{Oled}+I_{Leakage})-(I_{Leakage})$$

Figure 13:
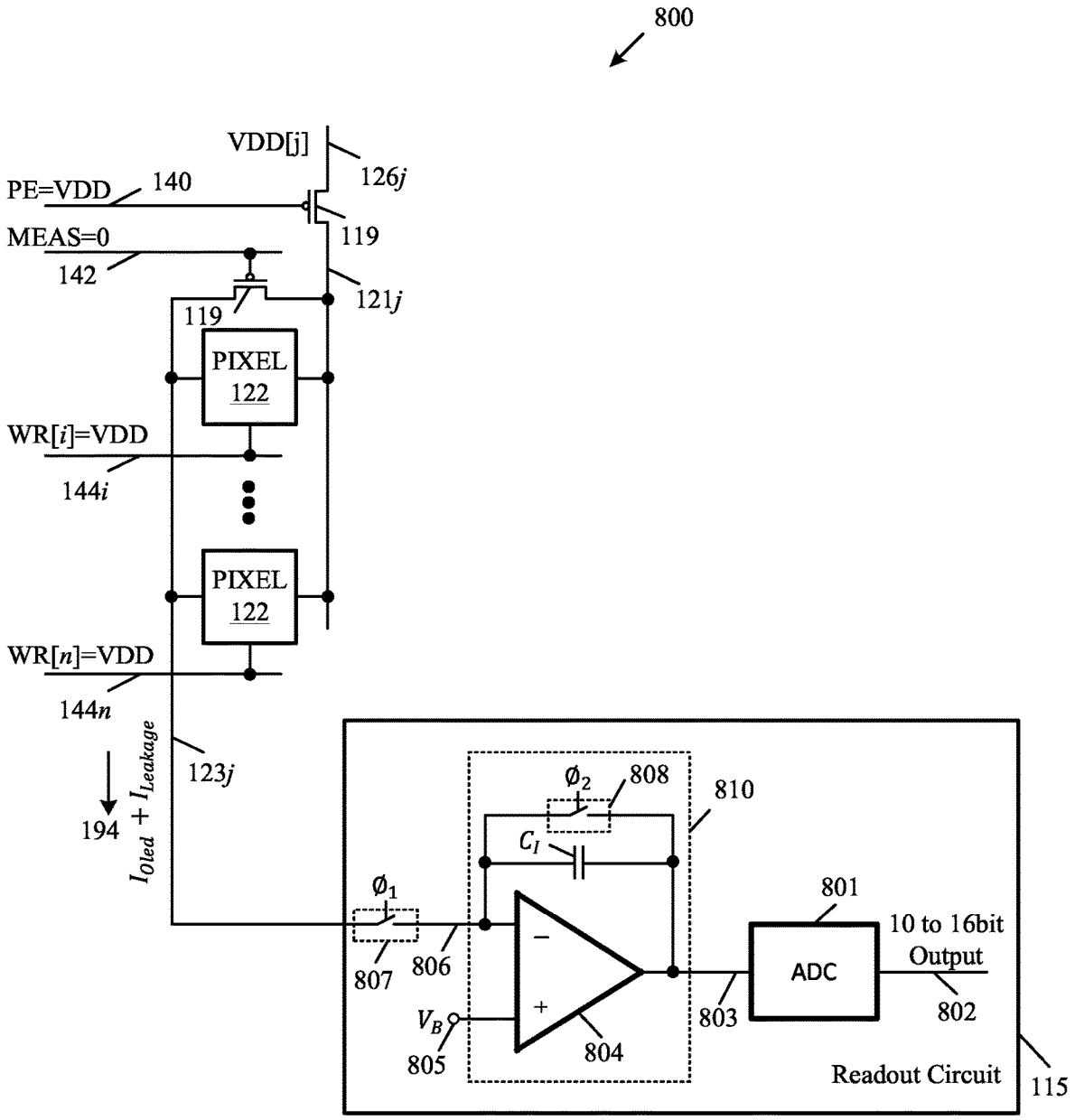
FIG. 13 is a block diagram of an embodiment of a column of pixel circuit ("jth" column) in measurement mode. The OLED current of the "ith" pixel plus the leakage currents of the other pixels are measured in this mode.

The ROC 115 as shown in FIG. 13 includes one switch 807, an integrator 810 and an analog to digital converter (ADC) 801. The integrator includes a reset switch 808, an integrating capacitor $C^I$ and a bias voltage $V_B$ 805. The integrator integrates the current coming from pixel 122 and converts it to a corresponding voltage. The voltage is converted to 10 to 16 bit digital code 802 by the ADC 801.

While particular embodiments and applications of the present invention have been illustrated and described, it is to be understood that the invention is not limited to the precise construction and compositions disclosed herein and that various modifications, changes, and variations can be apparent from the foregoing descriptions without departing from the spirit and scope of the invention as defined in the appended claims.

The invention claimed is:

1. A method of determining a current flowing in a display system, the display system including a plurality of pixel circuits arranged in rows and columns, a first pixel circuit of the plurality of pixel circuits coupled to a data line and coupled to a pixel supply voltage line, a first transistor coupled to the first pixel circuit via the data line and via the pixel supply voltage line, the method comprising:

during at least one mode of operation of the first pixel circuit, turning on the first transistor to complete a direct conductive coupling between the data line and the pixel supply voltage line; and measuring over the data line a current flowing over the pixel supply voltage line through the first transistor during the at least one mode of operation.

2. The method of claim 1, wherein the data line is coupled to more than one pixel circuit of the plurality of pixel circuits, and said first transistor is coupled to said more than one pixel circuit via the data line.

3. The method of claim 2, wherein the pixel supply voltage line is coupled to said more than one pixel circuit of the plurality of pixel circuits, and said first transistor is coupled to said more than one pixel circuit via the pixel supply voltage line.

4. The method of claim 1, wherein the display system includes a voltage supply for providing a supply voltage, and a supply voltage transistor coupled between the supply voltage and the pixel supply voltage line, the method further comprising:

during the at least one mode of operation of the first pixel circuit, turning off the supply voltage transistor to decouple the supply voltage from the pixel supply voltage line.

5. The method of claim 4, further comprising:

during a first at least one mode of operation of the first pixel circuit, measuring over the data line a leakage current flowing over the pixel supply voltage line and through the first transistor.

6. The method of claim 5, further comprising:

prior to a second at least one mode of operation of the first pixel circuit, programming the first pixel circuit over the data line; and during the second at least one mode of operation, measuring over the data line a combination of the leakage current and a current flowing through the first pixel circuit over the pixel supply voltage line and through the first transistor.

7. The method of claim 6, further comprising:

determining the current flowing through the first pixel circuit with use of a difference between the measured leakage current and the measured combination of the leakage current and the current flowing through the first pixel circuit.

8. The method of claim 7, wherein each pixel circuit comprises an organic light-emitting diode (OLED), and a drive transistor, the method further comprising:

during the second at least one mode of operation supplying the current flowing through the first pixel circuit to the OLED with use of the drive transistor according to said programming of the first pixel circuit.

9. The method of claim 8, wherein the first pixel circuit is programmed such that during the second at least one mode of operation the drive transistor operates in the triode region, and the current flowing through the first pixel circuit corresponds to the OLED current.

10. The method of claim 9, wherein the display system comprises a readout circuit, and wherein the readout circuit performs said measuring.

11. A display system comprising:

a plurality of pixel circuits arranged in rows and columns;

a data line;

a pixel voltage supply line;

a first pixel circuit of the plurality of pixel circuits coupled to the data line and coupled to the pixel supply voltage line;

a first transistor coupled to the first pixel circuit via the data line and via the pixel supply voltage line; and a controller adapted to control the plurality of pixels and the first switch, the controller further adapted to:

during at least one mode of operation of the first pixel circuit, turn on the first transistor to complete a direct conductive coupling between the data line and the pixel supply voltage line; and measure over the data line a current flowing over the pixel supply voltage line through the first transistor during the at least one mode of operation.

12. The display system of claim 11, wherein the data line is coupled to more than one pixel circuit of the plurality of pixel circuits, and said first transistor is coupled to said more than one pixel circuit via the data line.

13. The display system of claim 12, wherein the pixel supply voltage line is coupled to said more than one pixel circuit of the plurality of pixel circuits, and said first transistor is coupled to said more than one pixel circuit via the pixel supply voltage line.

14. The display system of claim 11, further comprising:

a voltage supply for providing a supply voltage; and a supply voltage transistor coupled between the supply voltage and the pixel supply voltage line, wherein the controller is further adapted to:

during the at least one mode of operation of the first pixel circuit, turn off the supply voltage transistor to decouple the supply voltage from the pixel supply voltage line.

15. The display system of claim 14, wherein the controller is further adapted to:

during a first at least one mode of operation of the first pixel circuit, measure over the data line a leakage current flowing over the pixel supply voltage line and through the first transistor.

16. The display system of claim 15, wherein the controller is further adapted to:

prior to a second at least one mode of operation of the first pixel circuit, program the first pixel circuit over the data line; and during the second at least one mode of operation, measure over the data line a combination of the leakage current and a current flowing through the first pixel circuit over the pixel supply voltage line and through the first transistor.

17. The display system of claim 16, wherein the controller is further adapted to:

determine the current flowing through the first pixel circuit with use of a difference between the measured leakage current and the measured combination of the leakage current and the current flowing through the first pixel circuit.

18. The display system of claim 17, wherein each pixel circuit comprises an organic light-emitting diode (OLED), and a drive transistor, and wherein during the second at least one mode of operation, the current flowing through the first pixel circuit is supplied to the OLED by the drive transistor according to said programming of the first pixel circuit.

19. The display system of claim 18, wherein the controller programs the first pixel circuit such that during the second at least one mode of operation the drive transistor operates in the triode region, and the current flowing through the first pixel circuit corresponds to the OLED current.

20. The display system of claim 19 further comprising a readout circuit, and wherein the controller controls said readout circuit to perform said measuring.

* * * * *